US008439185B2

(12) United States Patent
Fitzsimmons

(10) Patent No.: US 8,439,185 B2
(45) Date of Patent: May 14, 2013

(54) MULTIPLE MOVING WALL DRY COAL EXTRUSION PUMP

(75) Inventor: Mark Andrew Fitzsimmons, Reseda, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 218 days.

(21) Appl. No.: 12/758,859

(22) Filed: Apr. 13, 2010

(65) Prior Publication Data

US 2011/0247919 A1 Oct. 13, 2011

(51) Int. Cl.
*B65G 15/00* (2006.01)

(52) U.S. Cl.
USPC ..... 198/626.1; 415/5

(58) Field of Classification Search .... 198/626.2–626.4; 415/5
See application file for complete search history.

(56) References Cited

U.S. PATENT DOCUMENTS

| | | | | |
|---|---|---|---|---|
| 1,011,589 | A | 12/1911 | Curtis | |
| 2,836,285 | A * | 5/1958 | Muller | 198/821 |
| 3,245,517 | A | 4/1966 | Ward | |
| 3,258,110 | A * | 6/1966 | Pilcher | 198/626.4 |
| 3,844,398 | A | 10/1974 | Pinat | |
| 4,069,911 | A | 1/1978 | Ray | |
| 4,159,886 | A * | 7/1979 | Sage | 414/292 |
| 4,425,995 | A * | 1/1984 | Blattermann et al. | 198/605 |
| 4,585,118 | A | 4/1986 | Plaut | |
| 4,585,384 | A * | 4/1986 | Richard et al. | 414/141.1 |
| 4,611,646 | A | 9/1986 | Wassmer et al. | |
| 4,988,239 | A | 1/1991 | Firth | |
| 5,094,340 | A | 3/1992 | Avakov | |
| 5,435,433 | A | 7/1995 | Jordan et al. | |
| 5,492,216 | A | 2/1996 | McCoy et al. | |
| 5,875,697 | A * | 3/1999 | Cole et al. | 83/435.2 |
| 6,113,335 | A | 9/2000 | Kamiwaki | |
| 6,257,567 | B1 | 7/2001 | Hansmann et al. | |
| 6,264,022 | B1 * | 7/2001 | Petack et al. | 198/626.4 |
| 6,296,110 | B1 | 10/2001 | van Zijderveld et al. | |
| 6,484,870 | B2 * | 11/2002 | Bohnker et al. | 198/626.2 |
| 6,533,104 | B1 | 3/2003 | Starlinger-Huemer et al. | |
| 6,875,697 | B2 | 4/2005 | Trivedi | |
| 7,303,597 | B2 | 12/2007 | Sprouse et al. | |
| 7,387,197 | B2 | 6/2008 | Sprouse et al. | |
| 7,402,188 | B2 | 7/2008 | Sprouse | |
| 7,547,423 | B2 | 6/2009 | Sprouse et al. | |
| 7,615,198 | B2 | 11/2009 | Sprouse et al. | |

FOREIGN PATENT DOCUMENTS

| | | |
|---|---|---|
| CA | 1220753 | 4/1987 |
| GB | 1502524 | 3/1978 |
| GB | 2258442 | 2/1993 |
| JP | 57-2636 | 1/1982 |
| JP | 3-15814 | 2/1991 |

OTHER PUBLICATIONS

European Search Report dated Jul. 5, 2012 for European Application No. 11250444.4-2315/2377788.

Japanese Office Action dated Jan. 16, 2013 for Japanese Patent Application No. 2011-77274.

* cited by examiner

*Primary Examiner* — Mark A Deuble
(74) *Attorney, Agent, or Firm* — Carlson, Gaskey & Olds PC

(57) ABSTRACT

A pump for transporting particulate material includes a passageway defined on each side between an inlet and an outlet by a moving wall.

13 Claims, 4 Drawing Sheets

MULTIPLE MOVING WALL DRY COAL EXTRUSION PUMP

STATEMENT REGARDING FEDERALLY SPONSORED RESEARCH OR DEVELOPMENT

This disclosure was made with Government support under 2007LDA798PWR2007-42 awarded by The Department of Energy. The Government may have certain rights in this disclosure.

BACKGROUND

The present disclosure relates to a dry coal extrusion pump for coal gasification, and more particularly to a multiple moving wall arrangement therefor.

The coal gasification process involves conversion of coal or other carbon-containing solids into synthesis gas. While both dry coal and water slurry are used in the gasification process, dry coal pumping may be more thermally efficient than current water slurry technology. In order to streamline the process and increase the mechanical efficiency of dry coal gasification, the use of dry coal extrusion pumps has steadily become more common in dry coal gasification. Some currently available dry coal extrusion pumps suffer from internal shear failure zones and flow stagnation problems. The presence of failure zones may lead to decreased mechanical efficiency.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
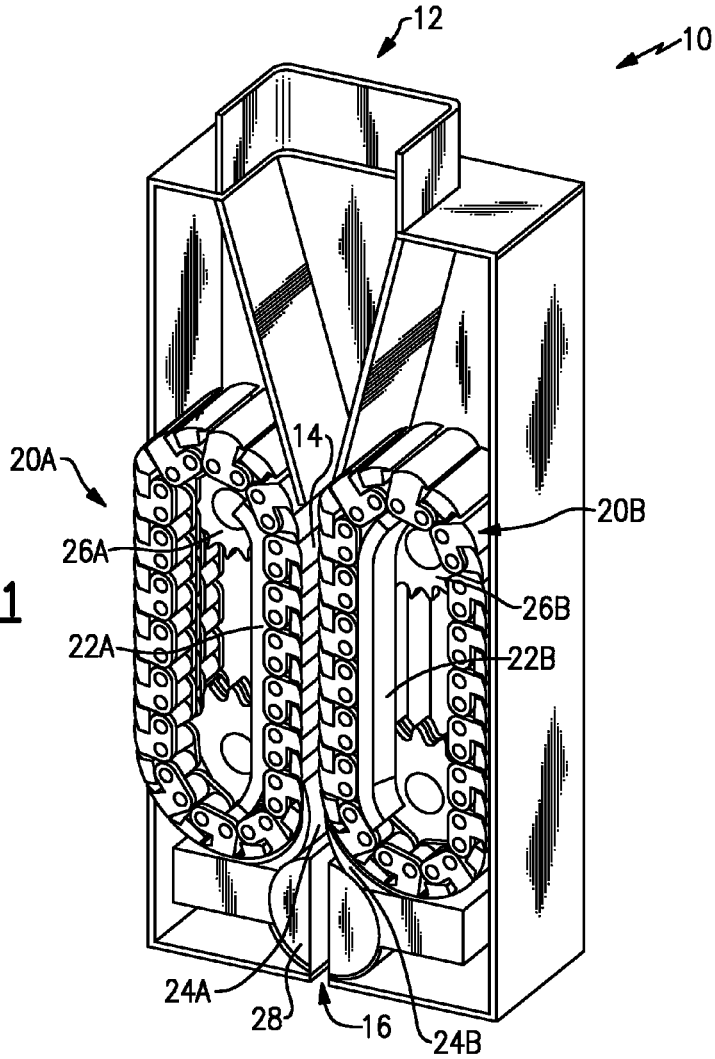
FIG. 1 is a sectional schematic view of a dry particulate material pump taken along line 1-1 in FIG. 2.
Figure 2:
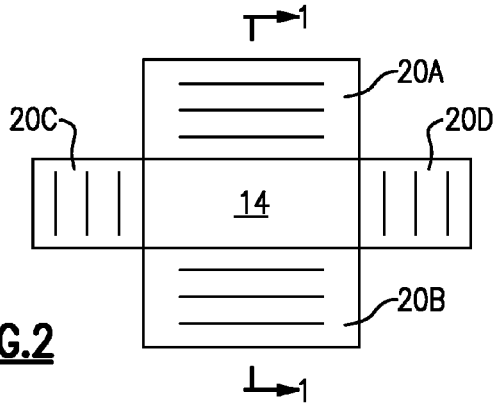
FIG. 2 is a top schematic view of the dry particulate material pump.

FIGS. 1 and 2 schematically illustrate a sectional and top view, respectively, of a dry coal extrusion pump 10 for transportation of a dry particulate material such as pulverized dry coal. Although pump 10 is discussed as transporting pulverized dry coal, pump 10 may transport any dry particulate material and may be used in various industries, including, but not limited to the following markets: petrochemical, electrical power, food, and agricultural.

The pump 10 generally includes an inlet 12, a passageway 14 and an outlet 16. The passageway 14 includes a multiple moving wall arrangement in which a moving wall 20A-20D (FIG. 2) defines each of four walls. It should be understood that the term "moving wall" as utilized herein operates as a belt to transport dry particulate material and generate work from the interaction between the moving walls 20A-20D and the material therebetween. In one non-limiting embodiment, each moving wall 20A-20D includes a respective load beam 22A-22D, scraper seal 24A-24D and drive arrangement 26A-26E (only two shown in sectional FIG. 1 view). For further understanding of other aspects of each moving wall 20A-20E, attention is directed to U.S. Pat. No. 7,387,197 which is assigned to the assignee of the instant invention and which is hereby incorporated herein in its entirety.

Pulverized dry coal is introduced into pump at inlet 12, communicated through passageway 14, and expelled from pump 10 at outlet 16. The outlet 16 may be controlled through a rotatable valve 28. The moving walls 20A-20D drive the pulverized dry coal through passageway 14.

Figure 3:
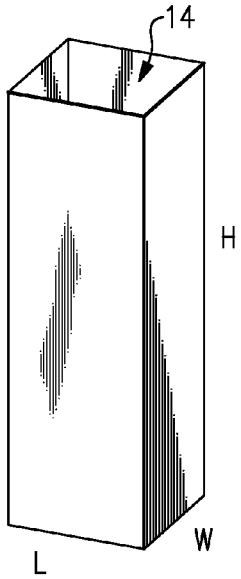
FIG. 3 is a schematic view of a passageway defined by the dry particulate material pump.

Referring to FIG. 3, an Aspect Ratio (AR) of the passageway 14 is defined by Height/Width. As the desired pumping pressure increases, the AR tends to increase. Furthermore, efficiency is generally determined by a Length/Width (L/W) ratio to generally control friction losses.

Figure 4:
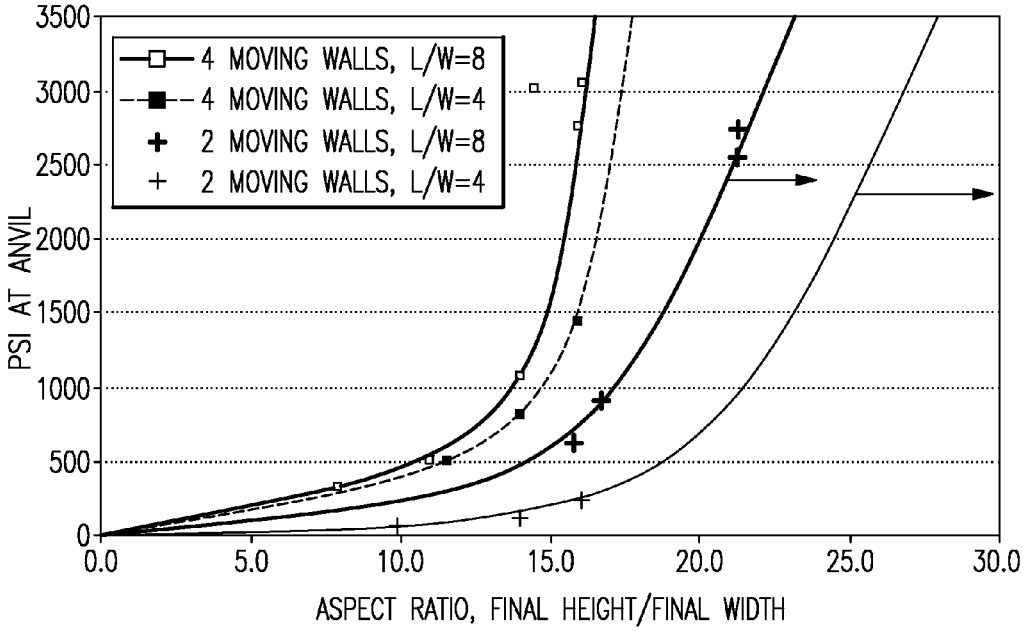
FIG. 4 is a graphical representation of pressure developed in a dry particulate material pump with two versus four moving walls at different aspect ratios and different L/W ratios.
Figure 5:
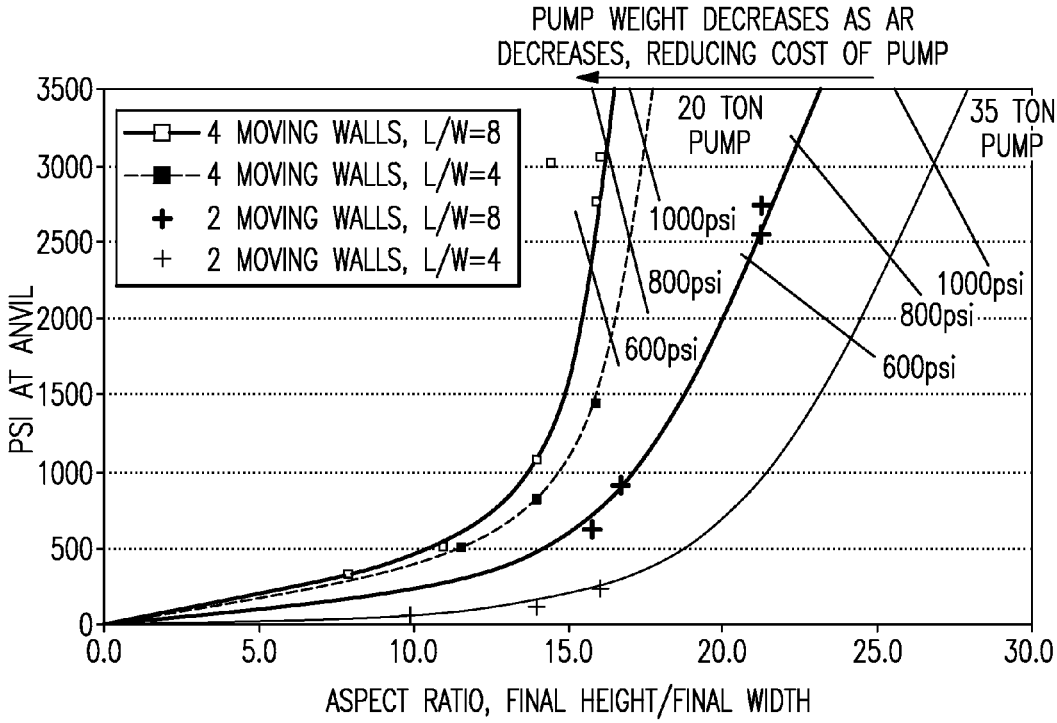
FIG. 5 is a graphical representation of Commercial pump design space and impact on cost of pump.

FIG. 4 graphically illustrates pressures developed in representative pumps with two versus four moving walls at different ARs and different L/W ratios. FIG. 4 graphically illustrates that having four moving walls 20A-20D, facilitates an pressure at a given aspect ratio AR that may be 50% larger than a pump with only two moving walls, with constant L/W ratio. When efficiency is taken into account, the pump 10 with four moving walls 20A-20D may have a L/W ratio between 3 and 4 such that the AR can be twice as large as that for a two moving wall arrangement. These relationships result in a benefit in which, for comparison, a two moving wall pump that weighs approximately 35 tons can be replaced by a four moving wall pump that has equivalent capabilities at a weight of only approximately 20 tons (FIG. 5).

Figure 6:
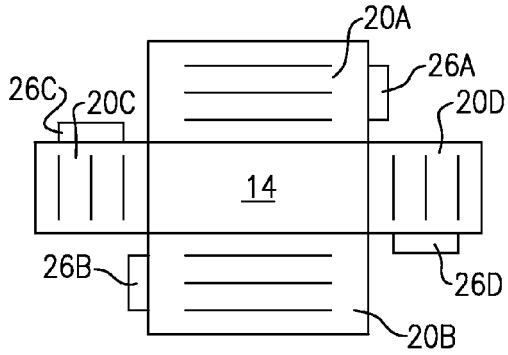
FIG. 6 is a top schematic view of the dry particulate material pump according to one non-limiting embodiment.

Referring to FIG. 6, one non-limiting embodiment of the moving walls 20A-20D are each independently driven. That is, each of the four moving walls 20A-20D are essentially equivalent systems driven by a respective drive arrangement 26A-26D.

Figure 7:
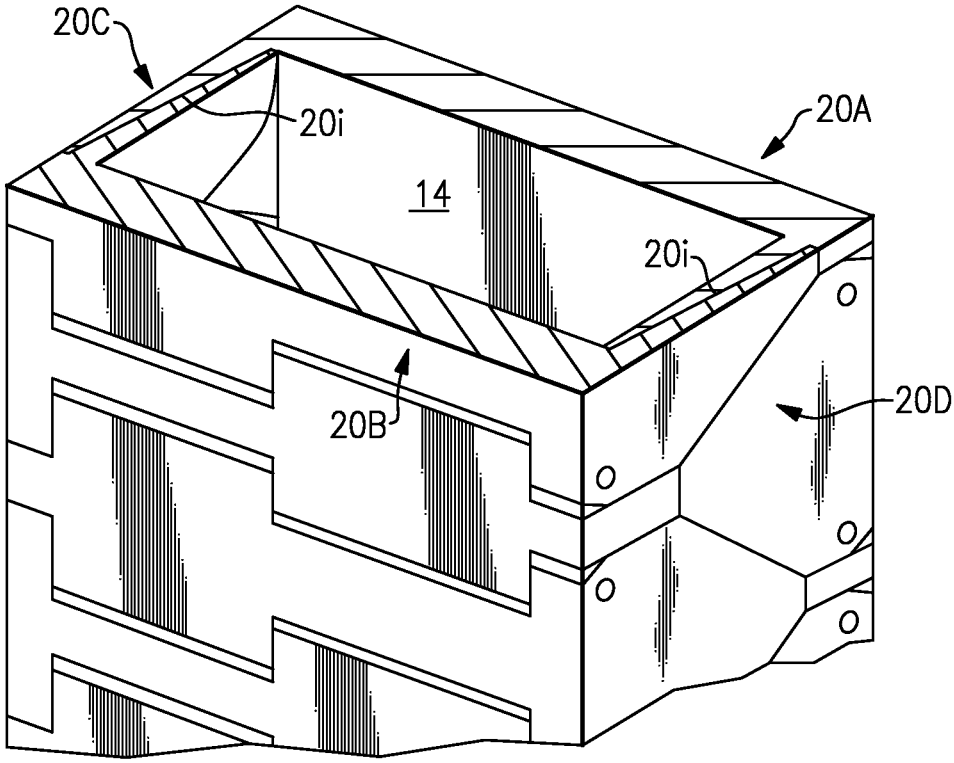
FIG. 7 is a top schematic view of the dry particulate material pump according to another non-limiting embodiment.

Referring to FIG. 7, another non-limiting embodiment of the moving walls 20A-20D include a three-dimensional arrangement in which the four moving walls 20A-20D are defined by two moving walls 20*a*, 20*b* which are generally U-shaped in cross-section. Although illustrated schematically without, for example, bearings and drive sprockets, an interlock 20*i* between the moving walls 20*a*, 20*b* forms the passageway 14.

Figure 8:
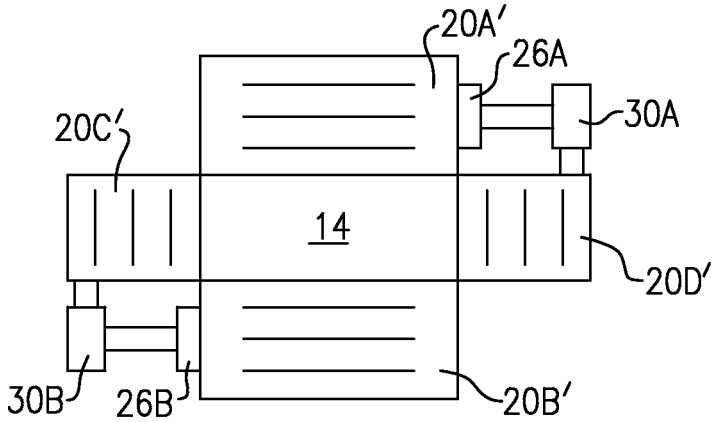
FIG. 8 is a top schematic view of the dry particulate material pump according to another non-limiting embodiment.

Referring to FIG. 8, another non-limiting embodiment of the moving walls 20A-20D include two driven moving walls 20A', 20B' which respectively drive idler moving walls 20C', 20D'. That is, idler moving walls 20C', 20D' are driven by driven moving walls 20A', 20B' though a gear arrangement 30A, 30B or other power transmission system.

If the angle θ between the two driven moving walls 20A', 20B' is greater than zero, as described in U.S. Pat. No. 7,387,197, then the FIG. 7 embodiment may be preferred over the FIG. 8 embodiment as a relatively less complicated interface may be provided. It should be understood that various drive arrangements may alternatively or additionally be provided for the moving walls 20A-20D.

It should be understood that other arrangements may alternatively be provided which, for example, alternate between the FIG. 7 and FIG. 8 embodiments.

It should be further understood that these arrangements contemplate small sections—such as the corners—which may be stationary, however, all sides of the passageway 14 will primarily be a "moving wall."

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A pump for transporting particulate material comprising:

a passageway defined at least partially on all sides between an inlet and an outlet by at least two moving walls spaced apart from each other such that essentially an entire perimeter of said passageway is movable; wherein no portion of said at least two moving walls contacts another portion of said at least two moving walls.

2. The pump as recited in claim 1, wherein said passageway is generally polygonal in cross-section.

3. The pump as recited in claim 1, wherein said passageway is generally round in cross-section.

4. The pump as recited in claim 1, wherein said passageway is defined by four moving walls.

5. The pump as recited in claim 1, wherein said passageway is defined by two driven moving walls and two idler moving walls driven by said two driven walls.

6. The pump as recited in claim 1, wherein said passageway defines a L/W Ratio greater than 3.

7. The pump as recited in claim 1, wherein said at least two moving walls each include no more than one portion defining said passageway, and said portion is completely planar.

8. The pump as recited in claim 1, wherein said at least two moving walls are driven separately from each other.

9. A particulate material transporting pump, comprising:

a first movable wall providing a perimeter side of a generally polygonal passageway;

a second movable wall providing another perimeter side of said passageway; and a third movable wall providing another perimeter side of said passageway, wherein said first, second, and third movable walls are separate from each other, wherein said first, second, and third movable walls are movable independently from each other.

10. The pump as recited in claim 9, wherein said first, second, and third movable walls each include portions that provide said perimeter sides, and said portions are entirely planar.

11. The pump as recited in claim 9, including a fourth moving wall, wherein said third and fourth movable walls are driven by said first and second moving walls, respectively.

12. The pump as recited in claim 9, wherein said passageway defines a L/W ratio of greater than 3.

13. A particulate material transporting pump, comprising:

a first movable wall providing a perimeter side of a generally polygonal passageway;

a second movable wall providing another perimeter side of said passageway, wherein said perimeter side provided by said first movable wall is aligned with said perimeter side provided by said second movable wall;

a third movable wall providing another perimeter side of said passageway; and a fourth movable wall providing another perimeter side of said passageway, wherein said perimeter side provided by said third movable wall is aligned with said perimeter side provided by said fourth movable wall, wherein said perimeter sides of said first, second, third, and fourth movable walls are disconnected from each other.

* * * * *